US009492915B2

(12) United States Patent
Largo et al.

(10) Patent No.: US 9,492,915 B2
(45) Date of Patent: Nov. 15, 2016

(54) HIGH EFFICIENCY ENGINE FOR COMBUSTION NAILER

(75) Inventors: Marc Largo, Gurnee, IL (US); Hanxin Zhao, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 413 days.

(21) Appl. No.: 13/222,549

(22) Filed: Aug. 31, 2011

(65) Prior Publication Data

US 2013/0048696 A1 Feb. 28, 2013

(51) Int. Cl.
*B25C 1/08* (2006.01)

(52) U.S. Cl.
CPC ..... *B25C 1/08* (2013.01)

(58) Field of Classification Search
USPC ..... 227/9, 10, 11, 130, 131; 123/46 SC, 123/46 H, 46 R; 173/209
See application file for complete search history.

(56) References Cited

U.S. PATENT DOCUMENTS

| | | | | | |
|---|---|---|---|---|---|
| 2,433,007 | A | * | 12/1947 | Weyandt | 173/209 |
| 2,875,737 | A | * | 3/1959 | Ueckert | 123/41.56 |
| 3,967,771 | A | | 7/1976 | Smith | |
| 4,403,722 | A | | 9/1983 | Nikolich | |
| 4,483,473 | A | | 11/1984 | Wagdy | |
| 4,483,474 | A | | 11/1984 | Nikolich | |
| 4,522,162 | A | | 6/1985 | Nikolich | |
| RE32,452 | E | | 7/1987 | Nikolich | |
| 5,150,836 | A | * | 9/1992 | McKay et al. | 239/5 |
| 5,197,646 | A | | 3/1993 | Nikolich | |
| 5,263,439 | A | | 11/1993 | Doherty et al. | |
| 5,806,747 | A | * | 9/1998 | Van Erden et al. | 227/10 |
| 5,975,397 | A | * | 11/1999 | Van Erden | B25C 1/04 227/10 |
| 6,012,622 | A | | 1/2000 | Weinger et al. | |
| 6,109,165 | A | | 8/2000 | Velan et al. | |
| 6,145,724 | A | | 11/2000 | Shkolnikov et al. | |
| 6,176,412 | B1 | | 1/2001 | Weinger et al. | |
| 7,201,301 | B2 | * | 4/2007 | Moeller | B25C 1/08 123/46 SC |
| 2005/0120983 | A1 | * | 6/2005 | Adams | 123/46 R |
| 2005/0173486 | A1 | * | 8/2005 | Moeller et al. | 227/10 |
| 2006/0175374 | A1 | * | 8/2006 | Zahner et al. | 227/10 |
| 2007/0251967 | A1 | * | 11/2007 | Taylor | B25C 1/08 227/10 |
| 2008/0190988 | A1 | * | 8/2008 | Pedicini et al. | 227/130 |
| 2009/0057365 | A1 | | 3/2009 | Murayama et al. | |
| 2009/0090759 | A1 | * | 4/2009 | Leimbach et al. | 227/10 |
| 2010/0176175 | A1 | | 7/2010 | Tamura et al. | |
| 2010/0213235 | A1 | * | 8/2010 | Pedicini et al. | 227/130 |
| 2011/0073630 | A1 | | 3/2011 | Kakuda et al. | |

FOREIGN PATENT DOCUMENTS

| | | |
|---|---|---|
| EP | 2 065 138 | 6/2009 |
| EP | 2 301 718 | 3/2011 |

OTHER PUBLICATIONS

International Search Report and Written Opinion for International Application No. PCT/US2012/052595, mailed Jan. 18, 2013 (10 pages).

International Preliminary Report on Patentability for International Application No. PCT/US2012/052595, dated Mar. 4, 2014 (7 pages).

* cited by examiner

*Primary Examiner* — Nathaniel Chukwurah
(74) *Attorney, Agent, or Firm* — Neal, Gerber & Eisenberg LLP

(57) ABSTRACT

A combustion tool is provided, including an engine with a ratio of cylinder volume to combustion chamber volume of at least 1.1.

7 Claims, 3 Drawing Sheets

HIGH EFFICIENCY ENGINE FOR COMBUSTION NAILER

BACKGROUND

The present invention relates generally to fastener-driving tools, and more specifically to such tools operating under combustion power, also referred to as combustion tools or combustion nailers.

Combustion nailers are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools are typically provided in a larger, higher powered "framing tool" type, and a smaller, lower powered "trim tool" type. While both types of tools operate according to very similar principles, the above-listed patents refer mainly to framing tools, and U.S. Pat. Nos. 6,176,412 and 6,012,622, both of which are incorporated by reference, disclose trim tools. Further, the conventional tools of both types include a tool housing enclosing a power source in the form of a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body.

To drive a fastener, the operator presses the nosepiece of the tool against the workpiece, causing a workpiece contact element (WCE) to retract relative to the nosepiece. The WCE is connected via an upper probe to a cylindrical valve sleeve, which in part defines a combustion chamber. The retraction of the WCE causes the valve sleeve to close and seal the combustion chamber, which also causes a metered dose of fuel into the combustion chamber. This action also energizes a fan in the combustion chamber to begin circulation of the vaporized fuel.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position through differential gas pressures within the cylinder. Fasteners are fed magazine-style into the nosepiece, where they are held in a properly positioned orientation for receiving the impact of the driver blade.

A valve sleeve is axially reciprocable about the cylinder and, through a linkage, moves to close the combustion chamber when a work contact element (WCE) at the end of the linkage is pressed against a workpiece. This pressing action also triggers a fuel-metering valve to introduce a specified volume of fuel into the closed combustion chamber.

Combustion-powered tools now offered on the market are sequentially operated tools. The tool must be pressed against the workpiece, retracting the WCE before the trigger is pulled for the tool to fire a nail. However, conventional combustion nailers tend to heat up quickly, which also causes tool energy degradation.

Thus, a common design parameter of combustion nailers is increasing tool efficiency and keeping the tool operating temperature within acceptable ranges. Another design parameter of combustion tools is providing sufficient power for driving fasteners into hard or resistant substrates, such as residential siding, while maintaining a tool size and weight which is conducive to prolonged use in the field without causing undue operator fatigue.

SUMMARY

The present tool features a combustion power source having increased driving power compared to conventional tools utilizing a combustion chamber of the same volume. By increasing the relative volume of the cylinder portion of the power source compared to the volume of the combustion chamber, increased driving power or energy has been achieved. Thus, when comparing the present tool to a conventional combustion tool of equivalent piston stroke, when the cylinder volume is increased relative to the combustion chamber volume, increased power is obtained while maintaining a consistent fuel dosage. Alternatively, when the combustion chamber volume is decreased and the cylinder volume (including piston stroke) is maintained constant, driving power or energy is maintained while reducing the fuel dosage. In the latter example, it is contemplated that a smaller profile tool is provided having driving power equivalent to the conventional tool. In addition, the respective increase in cylinder volume has not adversely affected piston return speed. In fact, piston return rates in the present tool are comparable to conventional framing and trim type combustion tools.

Preferred results have been achieved when the ratio of the cylinder volume to the combustion chamber volume is at least 1.1:1.0. Advantages of the present tool over conventional combustion nailers with cylinder volume to combustion chamber volumes of 1.0:1.0 or less include that the tool heats up more slowly, which improves operational efficiency, and makes more efficient use of the fuel dosage provided by the fuel cell.

More specifically, a combustion nailer is provided, including an engine with a ratio of cylinder volume to combustion chamber volume of at least 1.1:1.0.

In another embodiment, a combustion tool is provided, including a combustion engine having a cylinder head defining a top of a combustion chamber, a reciprocating valve sleeve moving between a rest position in which the combustion chamber is open, and a closed position in which the combustion chamber is sealed, the valve sleeve defining an outer wall of the combustion chamber in the closed position. A cylinder is disposed below the combustion chamber and accommodates a reciprocating piston having a depending driver blade. The piston reciprocates between a prefiring position, in which it is located at an upper end of the cylinder, and a fastener driving position in which it is located adjacent a lower end of the cylinder. The piston defines a lower end of the combustion chamber in the pre-firing position. A ratio of a volume of the cylinder to a volume of the combustion chamber is at least 1.1:1.0.

In yet another embodiment, a combustion nailer is provided having a combustion engine with a ratio of cylinder volume to combustion chamber volume of at least 1.1:1.0, and producing approximately 45 Joules of energy in a combustion cycle with a designated fuel dosage of approximately 13 mg.

DETAILED DESCRIPTION

Figure 1:
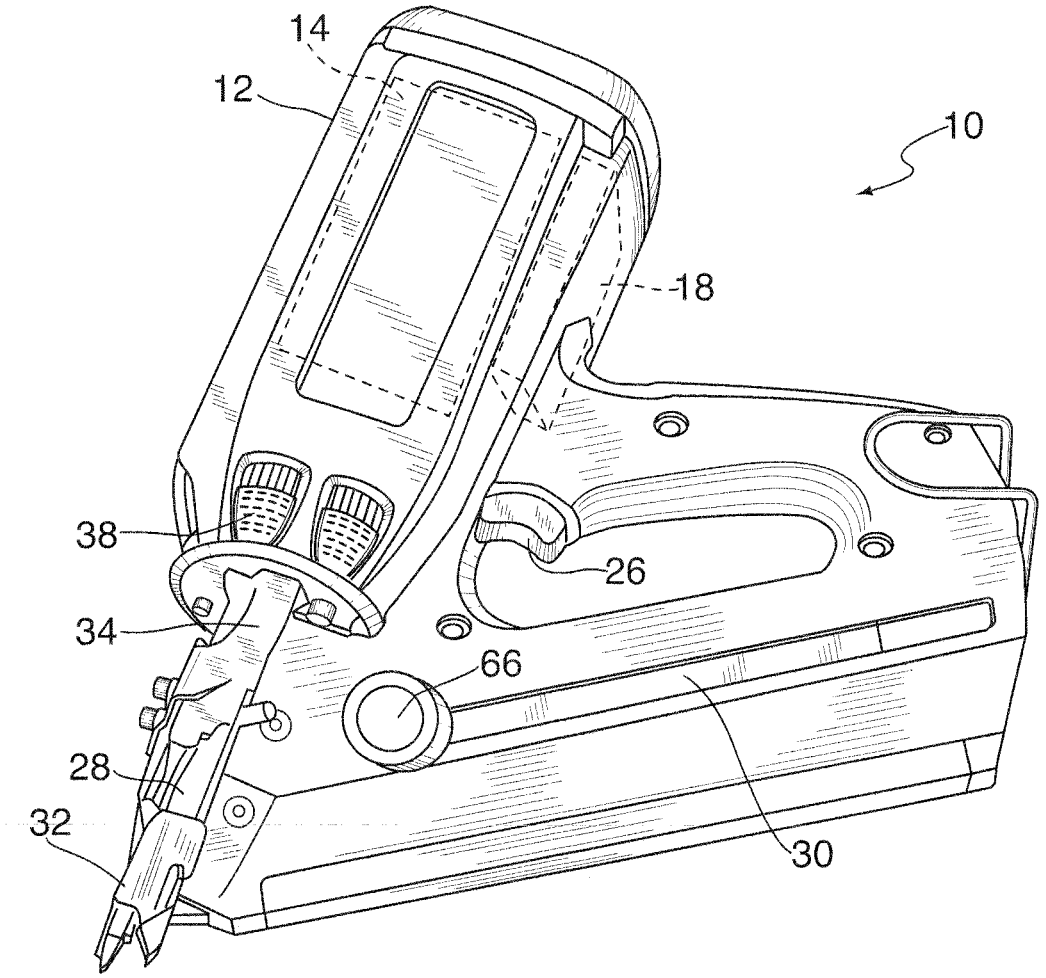
FIG. 1 is a perspective view of a combustion nailer equipped with the present invention.
Figure 2:
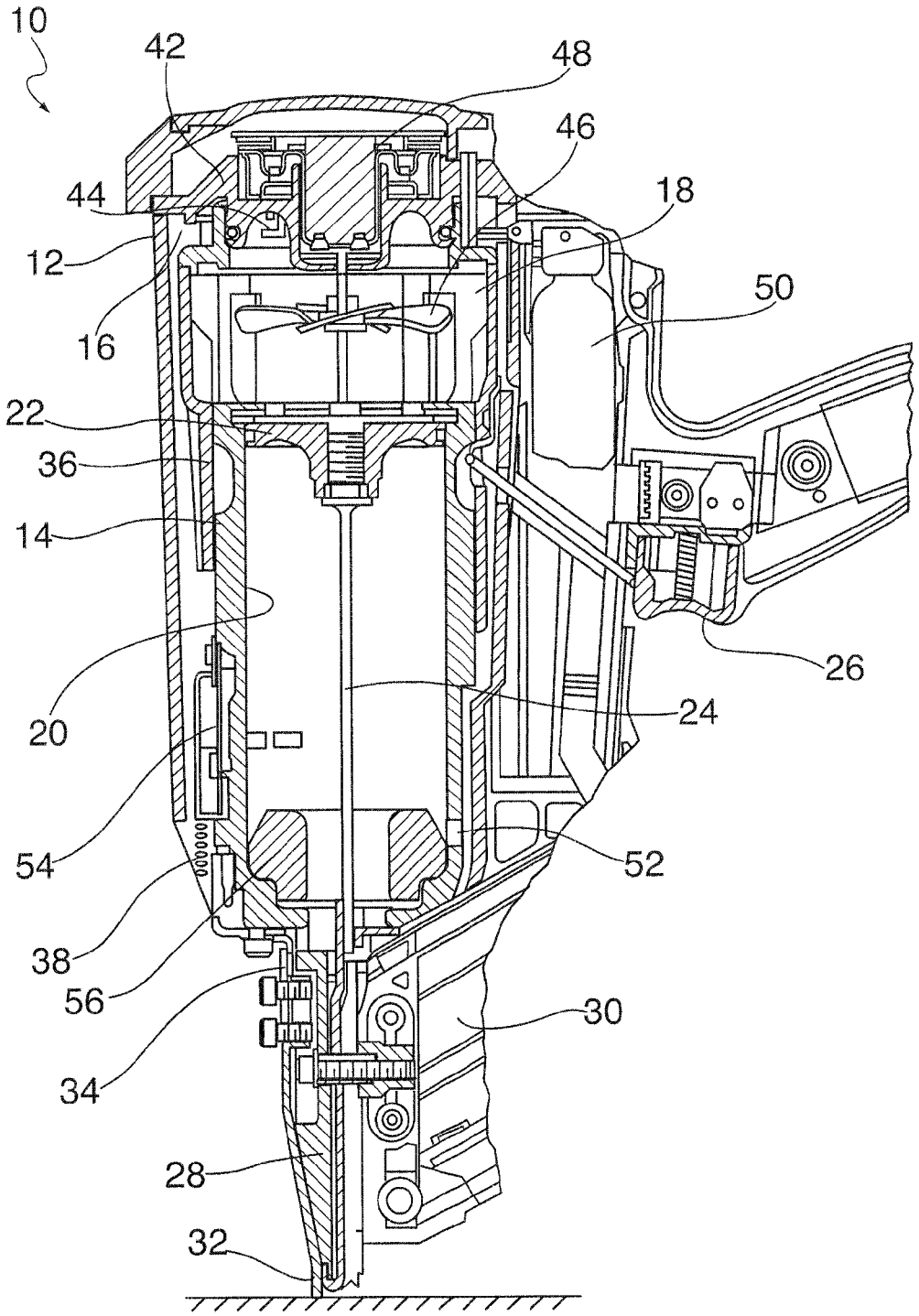
FIG. 2 is a fragmentary vertical section of the tool of FIG. 1.

Referring now to FIGS. 1 and 2, a combustion-powered fastener-driving tool incorporating the present invention is generally designated 10 and preferably is of the general type described in detail in the patents listed above and incorporated by reference in the present application. While FIGS. 1 and 2 depict a framing type of combustion nailer, it will be understood that the present invention is equally applicable to trim type tools or other types of fastener driving tools. A housing 12 of the tool 10 encloses a self-contained internal power source or combustion engine 14 (FIG. 2) within a housing main chamber 16. As in conventional combustion tools, the power source 14 is powered by internal combustion and includes a combustion chamber 18 that communicates with a cylinder 20 disposed below the combustion chamber 18 in the orientation of the tool 10 shown in FIGS. 1 and 2. As is well known in the art, the piston 22, reciprocally disposed within the cylinder 20, is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

The operator induces combustion within combustion chamber 18 through depression of a trigger or trigger switch 26, causing the driver blade 24 to be forcefully driven downward through a nosepiece 28. The nosepiece 28 guides the driver blade 24 to strike a fastener that had been delivered into the nosepiece via a fastener magazine 30.

Included in proximity to the nosepiece 28 is a workpiece contact element 32, which is connected, through a linkage 34 to a reciprocating valve sleeve 36, an upper end of which partially defines the combustion chamber 18. Depression of the tool housing 12 against the workpiece in a downward direction as seen in FIG. 1 (other operational orientations are contemplated as are known in the art), causes the WCE 32 to retract relative to the nosepiece 28 and to move from a rest position to a firing position. This movement overcomes the normally downward biased orientation of the workpiece contact element 32 caused by a spring 38 (shown hidden in FIG. 1). In FIG. 2, the tool 10 is depicted as being depressed against the workpiece, with the WCE 32 retracted.

Through the linkage 34, the workpiece contact element 32 is connected to and reciprocally moves with, the valve sleeve 36. In a rest position (not shown), the combustion chamber 18 is not sealed, since there are annular gaps, more specifically an upper gap separating the valve sleeve 36 and a cylinder head 42 which accommodates a spark plug 44, and a lower gap separating the valve sleeve 36 and the cylinder 20. In the preferred embodiment of the present tool 10, the cylinder head 42 also is the mounting point for a cooling fan 46 and an associated fan motor 48 powering the cooling fan. In the rest position, the tool 10 is disabled from firing because the valve sleeve 36 is not sealed with the cylinder head 42 or with the cylinder 20.

Thus, it will be understood that the combustion chamber 18 is defined by the cylinder head 42 at an upper end or top, the piston 22 in the pre-firing position at a lower end or bottom, and the valve sleeve 36 defining an outer peripheral or side wall when the valve sleeve is in the closed position.

Firing is enabled when an operator presses the workpiece contact element 32 against a workpiece. This action overcomes the biasing force of the spring 38, causes the valve sleeve 36 to move upward relative to the housing 12, closing the gaps and sealing the combustion chamber 18. In the present application, relative directional terms such as "upward" and "below" refer to the tool 10 in the orientation as depicted in FIGS. 1 and 2. This operation also induces a measured amount of fuel to be released into the combustion chamber 18 from a fuel canister or fuel cell 50 (shown in fragment in FIG. 2).

A suitable type of fuel is sold by ITW-Paslode as a PASLODE® Cordless fuel cell, containing compressed flammable liquefied gas, and such fuel was used in obtaining the comparative tool power data disclosed below. As such, in the comparative data, the fuel is referred to as a "designated fuel" to establish that the type of fuel is constant. It will be appreciated that other types and manufacturers of fuel cells exist on the market for use in combustion tools. In a comparison, the designated fuel may vary to suit the situation. Regardless of the type of designated fuel provided in the fuel cell, the performance results of the present tool compared to conventional tools are expected to be comparable to those provided below.

Upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder 20, it pushes a rush of air which is exhausted through at least one vent hole 52 located beyond the piston displacement (FIG. 2). Spent combustion gases behind the piston 22 exit through a petal check or exhaust valve 54. At the bottom of the piston stroke or the maximum piston travel distance, the piston 22 impacts a resilient bumper 56 as is known in the art. With the piston 22 beyond exhaust check valve 54, high pressure gases vent from cylinder 20 until near atmospheric pressure conditions are obtained and the check valve closes. After ignition and fastener driving, due to internal pressure differentials in the cylinder 20, the piston 22 is drawn back to the pre-firing position shown in FIG. 2.

Figure 3:
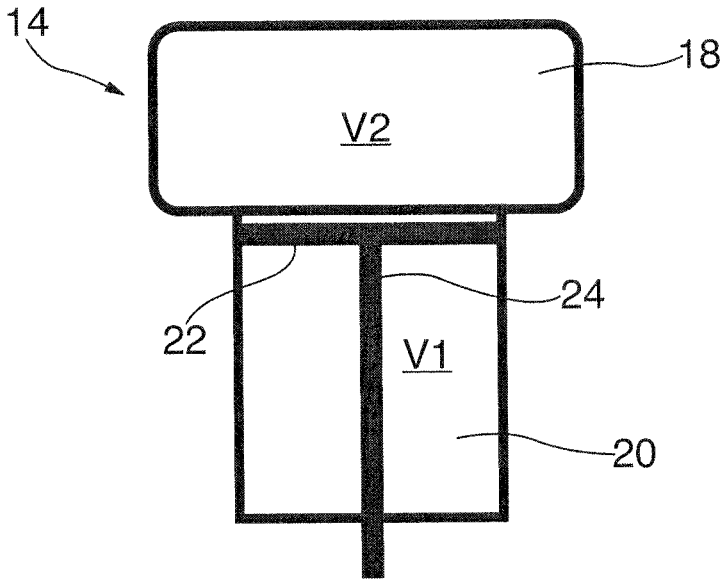
FIG. 3 is a schematic vertical section of FIG. 2 illustrating the relative parameters of the present combustion tool.

Referring now to FIG. 3, an important feature of the present tool 10 is that a ratio of a volume V1 of the cylinder 20 compared to a volume V2 of the combustion chamber 18 is at least 1.1:1.0. The volume V1 is measured in part from the distance of stroke or travel of the piston 22 between the position of the piston at the pre-firing position of FIG. 2 at one end, and when the piston impacts the top of the bumper 56, termed a fastener-driving position, at the other end. The area of the cylinder 20 is also included in the calculation of V1. During tool operation, at the fastener-driving position, the piston 22 has reached the lowermost point in its stroke or combustion cycle, and then returns to the pre-firing position. This return is due to differential gas pressures within the cylinder 20, provided that the valve sleeve 36 remains closed. In a conventional trim tool, the piston stroke is approximately 3.2-3.25 inches, and in a conventional framing tool, the piston stroke is approximately 4.2-4.25 inches, however these dimensions may vary to suit the situation.

The above-identified cylinder volume to combustion chamber volume ratio V2/V1 of at least 1.1:1.0 has been found to significantly increase tool fastener driving energy, measured in Joules, without increasing the fuel dosage. More specifically, a trim type tool having a ratio of at least 1.1:1.0 and preferably 1.2:1.0 has been found to produce approximately 45 Joules of fastener driving power using only 13 mg of the above-identified designated ITW-Paslode fuel. This fuel dosage is typical of a conventional trim type combustion nailer produced by ITW and sold under the PASLODE® brand, having a stroke of approximately 3.2-3.25 inches.

It has also been unexpectedly found that increasing the ratio above 1.1:1.0 did not delay piston return. In fact, the return of the piston 22 was achieved in the present tool 10 in approximately 80 msec. or less, which is typical for both conventional framing type and trim type combustion nailers.

When comparing an embodiment of the present tool 10 with a conventional trim type tool having a ratio of approximately 0.6:1.0-0.7:1.0 and a stroke of 3.2-3.25 inches, produces approximately 45 Joules of fastener driving energy, while the conventional trim tool produces 30 Joules of fastener driving energy, when both tools use a fuel dose of 13 mg of the above-identified designated ITW-Paslode fuel. In other words, the present tool 10 achieves approximately 50% greater combustion efficiency compared to a combustion tool having an equivalent stroke while using the same amount of fuel.

Thus, the present tool 10, having a ratio of cylinder volume to combustion chamber volume of at least 1.1:1.0 achieves increased fastener-driving energy for the size of the tool. As a result, a more efficient tool is provided, in which an output energy increase is realized with no increase in fuel consumption. Further, piston return rates are maintained within conventional expectations. Also, the tool 10 operates cooler, reducing operational stress and improving operator comfort.

When fastener driving energy in Joules was calculated per mg of fuel dose, comparing the conventional framing tool, trim tool and the present tool 10, the following data was obtained:

Conventional framing tool: 3.2 Joules/mg

Conventional trim tool: 2.5 Joules/mg

Present tool with 1.2 ratio: 3.45 Joules/mg

Thus, the present tool 10, having a ratio of cylinder volume to combustion chamber volume of at least 1.1 achieves increased fastener-driving energy for the size of the tool. As a result, a more efficient tool is provided, in which an output energy increase is realized with no increase in fuel consumption. Further, piston return rates are maintained within conventional expectations. Also, the tool 10 operates cooler, reducing operational stress and improving operator comfort.

While a particular embodiment of the present high efficiency engine for a combustion nailer has been described herein, it will be appreciated by those skilled in the art that changes and modifications may be made thereto without departing from the invention in its broader aspects and as set forth in the following claims.

What is claimed is:

1. A combustion tool having an engine with a ratio of cylinder volume to combustion chamber volume consisting of a range from 1.1:1.0 to 1.2:1.0, wherein said engine is constructed and arranged to achieve a post-combustion piston return in about 80 milliseconds or less.

2. The tool of claim 1, which has a piston stroke of approximately 3.2 to 3.25 inches, wherein said engine produces approximately 45 Joules of energy during a combustion cycle when provided a designated fuel dosage, wherein when used in a different compared tool having the same piston stroke of approximately 3.2 to 3.25 inches and a ratio of cylinder volume to combustion chamber volume from 0.6:1.0 to 0.7:1.0, the engine produces approximately 30 Joules of energy when provided the same designated fuel dosage.

3. The tool of claim 2, wherein said designated fuel dosage is approximately 13 milligrams.

4. The tool of claim 2, wherein approximately 50% greater energy is obtained compared to the compared tool.

5. The tool of claim 4, wherein the designated fuel dosage is approximately 13 milligrams.

6. The tool of claim 1, wherein a resulting driving energy per milligram of a designated fuel dosage is approximately 3.45 Joules/milligram.

7. A combustion nailer having a combustion engine with a ratio of cylinder volume to combustion chamber volume of at least 1.1:1.0 and having a piston stroke of approximately 3.2 to 3.25 inches and a first cylinder diameter, said engine producing approximately 45 Joules of energy in a combustion cycle when provided a designated fuel dosage of approximately 13 milligrams, wherein when used in a different compared combustion tool having the same piston stroke of approximately 3.2 to 3.25 inches and a second smaller cylinder diameter while using the same designated fuel dosage of approximately 13 milligrams, the engine produces approximately 30 Joules of energy.

* * * * *